US007798541B2

(12) United States Patent
Hirtsiefer

(10) Patent No.: US 7,798,541 B2
(45) Date of Patent: Sep. 21, 2010

(54) LID STAY

(75) Inventor: Artur Hirtsiefer, Neunkirchen-Seelscheid (DE)

(73) Assignee: Huwil-Werke GmbH Mobelschlob-und Beschlagfabriken, Ruppichteroth (DE)

( * ) Notice: Subject to any disclaimer, the term of this patent is extended or adjusted under 35 U.S.C. 154(b) by 485 days.

(21) Appl. No.: 10/546,875

(22) PCT Filed: Apr. 10, 2004

(86) PCT No.: PCT/EP2004/003835

§ 371 (c)(1), (2), (4) Date: Jun. 21, 2006

(87) PCT Pub. No.: WO2004/104339

PCT Pub. Date: Dec. 2, 2004

(65) Prior Publication Data

US 2006/0279092 A1 Dec. 14, 2006

(30) Foreign Application Priority Data

May 22, 2003 (DE) ..... 103 23 698

(51) Int. Cl.
*E05C 17/04* (2006.01)
*E05C 17/32* (2006.01)

(52) U.S. Cl. ..... 292/262; 292/263; 292/DIG. 19; 16/286; 49/386

(58) Field of Classification Search ..... 292/262, 292/263, DIG. 19; 16/286; 49/386
See application file for complete search history.

(56) References Cited

U.S. PATENT DOCUMENTS

| | | | | | |
|---|---|---|---|---|---|
| 1,122,322 | A | * | 12/1914 | Smith | 16/292 |
| 1,653,448 | A | * | 12/1927 | Bommer | 16/284 |
| 2,012,731 | A | | 8/1935 | Sasgen | |
| 2,035,823 | A | * | 3/1936 | Moore | 16/284 |
| 2,219,824 | A | * | 10/1940 | Schonitzer | 16/85 |
| 5,867,871 | A | * | 2/1999 | Tasman | 16/335 |
| 5,904,411 | A | * | 5/1999 | Hayakawa | 312/319.2 |

(Continued)

FOREIGN PATENT DOCUMENTS

DE 25 18 942 11/1976

(Continued)

*Primary Examiner*—Carlos Lugo
(74) *Attorney, Agent, or Firm*—Sughrue Mion, PLLC

(57) ABSTRACT

A lid stay, for furniture, including a first arm (1) and a second arm (2) which are connected to each other so as to be pivotable about a swivel pin (3) between an open position and a closed position; a convex positioning contour (4) that is disposed on the first arm (1), extends around a central axis (5) located parallel to the swivel pin (3), and has the shape of a circular arc when viewed from a cross-section running perpendicular to the central axis (5); a positioning slide (8) which is movably guided along a positioning axis (9) by means of the first arm (1), is provided with a flat support area (12) facing the positioning contour (4), and is spring-biased in the direction of the positioning contour (4); and a sliding block (13), a concave first sliding surface (14) of which slidably leans on the positioning contour (4), while a flat second sliding surface (15) thereof slidably leans on the support area (12). The first sliding surface (14) extends around the central axis (5) in the shape of a circular arc and has the same curvature as the positioning contour (4).

10 Claims, 2 Drawing Sheets

U.S. PATENT DOCUMENTS

Figure 1:
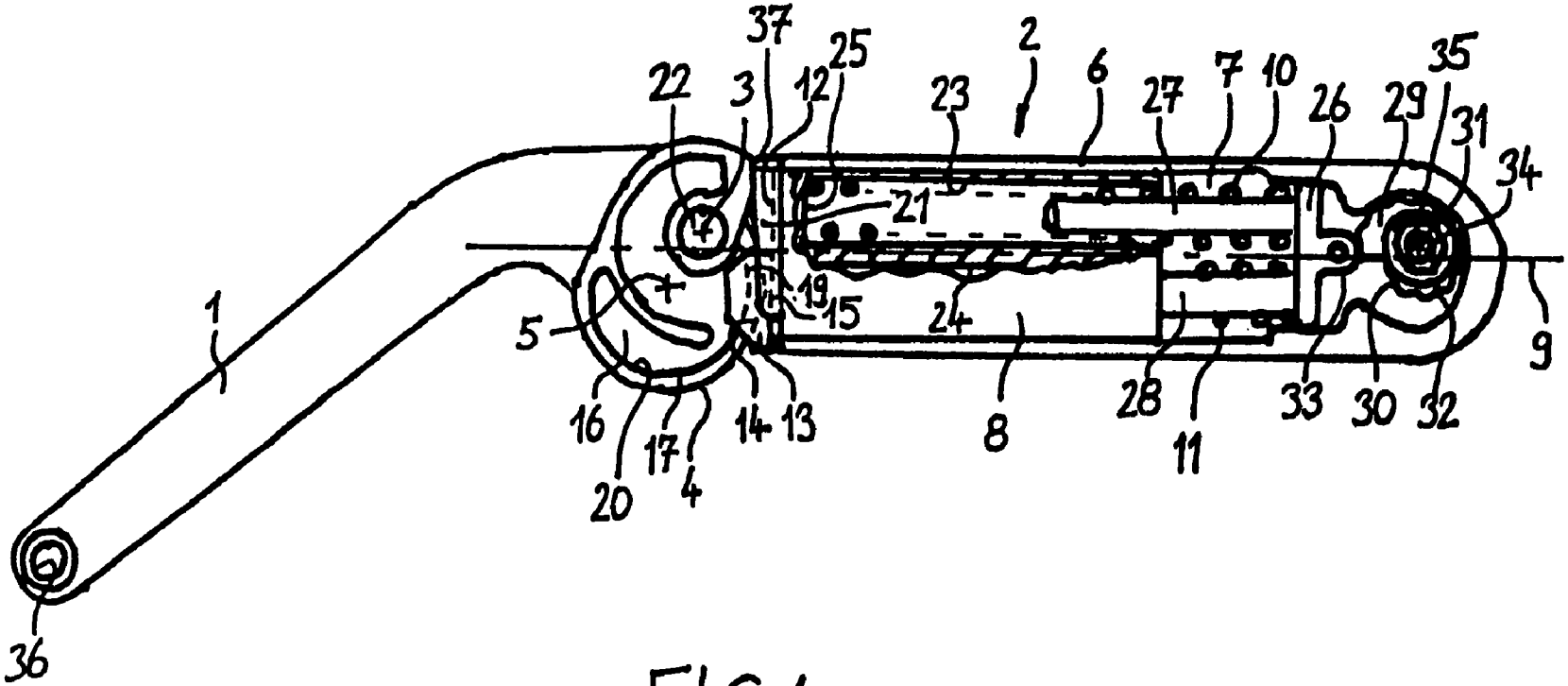

| | | | | |
|---|---|---|---|---|
| 6,415,477 | B1 * | 7/2002 | Hosaka et al. | 16/327 |
| 6,463,627 | B1 * | 10/2002 | Hirtsiefer | 16/286 |
| 6,629,336 | B2 * | 10/2003 | Hosaka et al. | 16/327 |
| 6,886,220 | B2 * | 5/2005 | Kuramochi | 16/286 |
| 7,240,974 | B2 * | 7/2007 | Hirtsiefer | 312/109 |

FOREIGN PATENT DOCUMENTS

| | | | |
|---|---|---|---|
| DE | 2653106 | * | 5/1978 |
| DE | 299 03 503 | U1 | 5/1999 |
| EP | 1148200 | A2 | 4/2001 |

* cited by examiner

LID STAY

The invention relates to a lid stay for holding a lid or a flap of a furniture piece. The lid is generally arranged vertically and pivotably connected on a furniture piece. By means of hinges, e.g. at an upper edge of the lid, the lid is attached pivotably on a corpus of the furniture piece. The lid can be tilted from the vertical closed position upwards into an open position, in which the lid is arranged generally horizontal or inclined.

DE 299 03 503 U1 describes a lid stay, which has a first arm and a second arm, which are connected pivotably around a pivot axis. The first arm forms an adjustment contour in form of a curve, which radial distance to the pivot axis increases, starting from a first position of the two arms relative to each other along a part of the angular path at least and decreases again towards the end of the angular path. To the second arm, an adjustment slider is arranged, which is displaceably supported and which is urged by means of springs into contact with the adjustment contour of the first arm. The lid stay serves for holding a lid of a roof box, wherein the adjustment contour is formed such, that over the largest angular path the lid stay is urged to a position, corresponding to the open position of a lid of the roof box. Over a smaller angular path a drawing-in torque in direction towards a position of the two arms is produced, which corresponds to the closed position of the lid of the roof box. The opening torque in direction towards the open position of the lid is achieved by the increasing radial distance of the adjustment contour relative to the pivot axis. In this case, the curve of the adjustment contour is adapted to the kinematic conditions, so that permanently a sufficient torque is produced, to lift the lid or to retain the same in any position. The adjustment slider forms here a support face, which is forced into abutment with the adjustment contour. The support face is, in this case, formed V-like, when seen in a sectional plane perpendicular to the pivot axis, so that a line contact is formed between the adjustment slider and the adjustment contour. As thus a very small contact face is achieved, high surface pressures are produced, which limit the maximum lid weight, which can be held by the lid stay, and which reduce the life span of the lid stay.

Object of the present invention is, to provide a lid stay, which has a longer life span.

The object is solved according to the invention by a lid stay, especially for furniture, comprising

- a first arm and a second arm, which are pivotably connected to each other around a pivot axis between an open position and a closed position,
- a convex adjustment contour, which is provided on the first arm and which extends around a centre axis arranged parallel to the pivot axis and is formed as a circular arc when seen in a sectional view vertical to the centre axis,
- an adjustment slider, which is guided displaceably by means of the second arm along an adjustment axis and which has a plane support face directed to the adjustment contour and which is elastically loaded in the direction towards the adjustment contour,
- a slide shoe, which is, with a concave first sliding face, in sliding contact with the adjustment contour and which is, with a plane second sliding face, in sliding contact to the support face, wherein the first sliding face extends circular arc-like around the centre axis and has the same curvature as the adjustment contour.

The adjustment contour is formed as a circular arc, when seen in a sectional view vertical to the centre axis, wherein the first sliding face of the slide shoe is formed form-fittingly. Therefore, a surface to surface contact between the adjustment contour and the first sliding face is ensured, wherein the complete first sliding face contacts in a surface to surface contact the adjustment contour. Thus, point contacts or line contacts with a high surface pressure are prevented.

Furthermore, the support face of the adjustment slider as well as the second sliding face of the slide shoe are formed plane, so that these abut each other in a surface to surface contact. Thus, also between the slide shoe and the adjustment slider a point or line contact is prevented.

Because of the surface to surface contact of the slide shoe and on the adjustment contour as well as on the support face the surface pressure is distinctly reduced, so that the lid stay has a longer life span. Furthermore, the slide shoe can be easily exchanged, so that slide shoes made from different materials can be used. Therefore, the produced frictional force can be varied, so that the lid stay can be adapted easily to different requirements. Preferably, the slide shoe is made from a different material than the adjustment contour and the support face.

By means of pairing of materials and the eccentricity of the adjustment contour the torque characteristics of the lid stay can be adjusted such, that the to be retained lid is held in any position.

Furthermore, the adjustment contour, viewed in a cross-sectional view, can be formed spherically as well as straight, wherein the first sliding face is formed form-fittingly in cross-section.

To ensure a secure guidance of the slide shoe along the adjustment contour, the first arm has a relative to the centre axis axially projecting bead, which extends along the adjustment contour and which engages in a correspondingly formed groove of the slide shoe, wherein the groove forms the first sliding face. Thus, the slide shoe can be plugged onto the bead and is guided along the same when displacing the two arms relative to each other.

As the adjustment contour is arranged concentrically to the centre axis, a change in distance of the contact area between the slide shoe and the adjustment contour to the pivot axis is achieved along the pivot path of the two arms relative to each other. Thus a torque is produced by the adjustment slider, which forces the slide shoe against the adjustment contour.

Preferably, the radial distance of the adjustment contour to the pivot axis decreases towards the open position in the contact range between the slide shoe and the adjustment contour at least along a first part of the pivot path, starting from an intermediate position of the two arms relative to each other, which is arranged between the open position and the closed position.

Furthermore, it can be provided, that the radial distance of the adjustment contour relative to the pivot axis increases towards the intermediate position in the contact range between the slide shoe and the adjustment contour along a second part of the pivot path, starting from the closed position of the two arms relative to each other.

The support face is arranged crosswise to the adjustment axis, wherein the adjustment axis is preferably not arranged vertically to the support face. The support face can be arranged at any angle, whereby the torque characteristics can be adjusted along the pivot path of the two arms relative to each other. The support face can be formed integrally with the adjustment slider or instead be part of a separate component, which is connected to the adjustment slider. The separate component can be exchanged, to change the angle of the support face relative to the adjustment direction of the adjustment slider.

Furthermore, a support bearing can be provided, which is held at a variable distance to the pivot axis, wherein compression springs are provided, which on the one hand are supported on the adjustment slider and on the other hand on the support bearing. In this case, the support bearing can be supported on a bearing face of an abutment bearing, which are supported pivotably around a rotational axis, wherein the bearing face has in circumferential direction an adjustable distance relative to the rotational axis. Preferably, the bearing face is formed worm-like.

The arms have, respectively, at a free end, facing away from the pivot axis, connection means for connecting the respective arm to a lid or a corpus of a furniture piece.

If a support bearing is provided, this can have a bore extending parallel to the pivot axis, which represents the connection means of the second arm.

A preferred embodiment is described in more detail in the following by means of the drawings.

It shows

Figure 2:
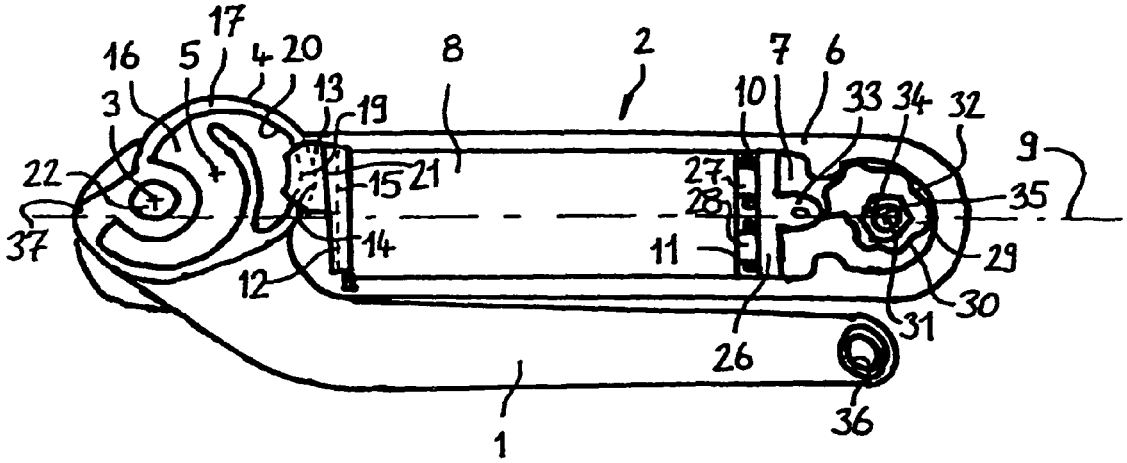
Figure 3:
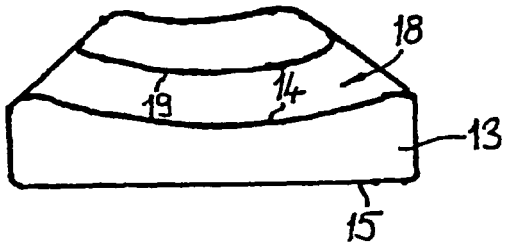

FIG. 1 a partial longitudinal sectional view of a lid stay according to the invention in the open position, FIG. 2 the lid stay of FIG. 1 in its closed position, and FIG. 3 a top view of a slide shoe.

FIGS. 1 and 2 show an embodiment of a lid stay according to the invention in two different positions and are described together in the following.

The lid stay comprises a first arm 1 and a second arm 2, which are pivotably connected to each other by a pivot pin 22 around a pivot axis 3. The two arms 1, 2 can be pivoted relative to each other between an open position shown in FIG. 1 and a closed position shown in FIG. 2.

The first arm 1 forms on the end facing the second arm 2 a convex adjustment contour 4, which is arranged around a centre axis 5 arranged parallel to the pivot axis 3 and which is formed as a circular arc, when seen in a sectional view vertical to the centre axis 5. The adjustment contour 4 is, thus, arranged eccentrically to the pivot axis 3.

The second arm 2 comprises a housing 6 and a lid not shown here, wherein the housing 6 and the lid enclose an inner chamber 7. In the inner chamber 7 an adjustment slider 8 is slidingly guided along an adjustment axis 9. The adjustment slider 8 is forced upon by a force by means of compression springs 10, 11 in direction towards the adjustment contour 4. The adjustment slider 8 forms a plane support face 12 facing the adjustment contour 4 and with which the adjustment slider 8 is supported on a slide shoe 13, wherein the slide shoe 13 is again supported on the adjustment contour 4 of the first arm 1. The adjustment slider 8 is, thus, indirectly supported via the slide shoe 13 on the adjustment contour 4 of the first arm 1.

The slide shoe 13 forms a concave first sliding face 14, which is held in surface to surface contact to the adjustment contour 4. For this, the first sliding face 14 extends around the centre axis 5, arranged parallel to the pivot axis 3, and is formed as a circular arc when seen in a sectional view vertical to the centre axis 5. The first sliding face 14 has, in this case, the same radius or the same curvature, respectively, as the adjustment contour 4.

Furthermore, the slide shoe 13 forms a second sliding face 15, which is in surface to surface contact to the support face 12 of the adjustment slider 8. For this, the second sliding face 15 is also formed as plane as the support face 12.

The first arm 1 has on its end forming the adjustment contour 4 a surface 16, which extends vertically to the pivot axis 3. A bead 17 projects axially from this surface 16 in relation to the pivot axis 3, wherein the bead 17 extends along the adjustment contour 4. The slide shoe 13 has a groove 18, shown in FIG. 3, which is formed in correspondence to the bead 17. The bead 17 has a constant thickness, wherein the width of the groove 18 corresponds to the thickness of the bead 17. The groove 18 forms the first sliding face 14 as well as a first guide face 19, which abuts a second guide face 20 of the bead 17, wherein the second guide face 20 is arranged on the side of the bead 17 facing away from the adjustment contour 4. Thus, the slide shoe 13 is guided along the bead 17.

The adjustment slider 8 has a guide wall 21 delimiting the support face 12, along which the slide shoe 13 is displaceable relative to the support face 12. The guide wall 21 extends parallel to the surface 16. The guide wall 21 is supported on the slide shoe 13 on the side facing away from the groove 18. Thus, the slide shoe 13 is securely held against displacements in the direction towards the pivot axis 3.

The adjustment slider 8 has two blind holes 23, 24 extending parallel to the adjustment axis 9. The blind holes 23, 24 have, respectively, a hole end 25, at which, respectively, one of the compression springs 10, 11 is supported in the direction towards the adjustment contour 4. The other end of the compression springs 10, 11, respectively, is supported on a support bearing 26. The support bearing 26 forms rods 27, 28, onto which, respectively, the compression springs 10, 11 are plugged on and are inserted into the blind holes 23, 24. Thus, the compression springs 10, 11 are securely held by the blind holes 23, 24 and by the rods 27, 28, so that a buckling of the compression springs 10, 11 is prevented crosswise to the adjustment axis 9.

The support bearing 26 is displaceably guided in the housing 6. In this case, it is supported on a support face 30 of an abutment bearing 29, wherein the abutment bearing 29 is pivotably supported around a rotational axis 31 in the housing 6, and wherein the bearing face 30 has a variable distance to the rotational axis 31 of the abutment bearing 29, so that the support bearing 26 is held with an adjustable distance to the pivot axis 3 in the housing 6. The bearing face 30 is formed worm-like and has radial snap-in recesses 32, in which the snap-in projection 33 of the support bearing 26 engages, to prevent, that the abutment bearing 29 is rotated unintentionally. To be able to rotate the abutment bearing 29 around the rotational axis 31, this has a hexagon socket profile 34, so that the abutment bearing 29 can be turned by a hexagon socket key and the pre-tensioning of the compression springs 10, 11 can be varied. Furthermore, the abutment bearing 29 has a bore 35, which serves as a connection means for connecting the second arm 2 to the lid or a corpus of a furniture piece. The first arm 1 has, also, at its free end facing away from the second arm 2 a bore 36, which also serves as a connection means for connecting the lid stay to a corpus of a furniture piece or a lid.

In FIG. 1 the two arms 1, 2 are in their open position. In this case, an end position abutment 37 of the first arm 1 abuts the support face 12, so that a pivoting of the two arms 1, 2 beyond the open position is prevented. Furthermore, the adjustment contour 4 is arranged eccentrically to the pivot axis 3, so that, when pivoting the two arms 1, 2 from the open position in direction towards the closed position shown in FIG. 2, the distance between the contact area of the first sliding face 14 of the slide shoe 13 on the adjustment contour 4 and the pivot axis 3 is initially enlarged. Thus, by means of pivoting the two arms 1, 2 from the open position in direction towards the closed position, the adjustment slider 8 is displaced along the adjustment axis 9 in direction towards the support bearing 26 against the spring force of the compression springs 10, 11. Thus, a torque is produced in direction towards the open position.

During this pivot movement the first sliding face 14 of the slide shoe 13 slides on the adjustment contour 4. Furthermore, the second sliding face 15 of the slide shoe 13 slides on the support face 12 of the adjustment slider 8. The frictional force can be influenced by the material combination between the faces sliding on each other. The torque characteristics can be varied along the pivot path by the eccentricity of the adjustment contour 4 to the pivot axis 3 and by the angle of the support face 12 relative to the adjustment axis 9.

After reaching an intermediate position, which is positioned between the open position and the closed position, the distance between the contact area of the first sliding face 14 of the slide shoe 13 on the adjustment contour 4 and the pivot axis 3 decreases again such, that a torque is produced in direction towards the closed position, as along this pivot range the adjustment slider 8 is again moved in direction towards the pivot axis 3 and is supported by the compression springs 10, 11. The pivot range between the intermediate position and the closed position is generally relative small, so that only in the last pivot range, shortly before reaching the closed position, a drawing-in torque is achieved, so that the lid is retained securely in the closed position.

The invention claimed is:

1. Lid stay, comprising:

a first arm (1) and a second arm (2), which are pivotably connected to each other around a pivot axis (3) between an open position and a closed position, a convex adjustment contour (4), which is provided on the first arm (1) and which extends around a centre axis (5) arranged parallel to the pivot axis (3) and is formed as a circular arc, when seen in a sectional view vertical to the centre axis (5), an adjustment slider (8), which is displaceably guided by means of the second arm (1) along an adjustment axis (9) and which has a straight support face (12) directed to the adjustment contour (4) and is elastically loaded in the direction towards the adjustment contour (4), a slide shoe (13), which is, with a concave first sliding face (14), in sliding contact with the adjustment contour (4) and which is, with a straight second sliding face (15), in sliding contact to the support face (12), wherein the first sliding face (14) extends in a circular arc around the centre axis (5) and has the same curvature as the adjustment contour (4), wherein the first arm (1) has an axial projecting bead (17) extending along the adjustment contour (4) and which engages in a correspondingly formed groove (18) of the slide shoe (13), and wherein the groove (18) forms the first sliding face (14).

2. Lid stay according to one of claim 1, wherein the radial distance of the adjustment contour (4) relative to the pivot axis (3) decreases towards open position in the contact range between the slide shoe (13) and the adjustment contour (4) at least along a first part of the pivot path, starting from an intermediate position of the two arms (1, 2) relative to each other, which is arranged between the open position and the closed position.

3. Lid stay according to claim 2, wherein the radial distance of the adjustment contour (4) relative to the pivot axis (3) increases in the contact range between the slide shoe (13) and the adjustment contour (4) along a second part of the pivot path, starting from the closed position of the two arms (1, 2) relative to each other towards the intermediate position.

4. Lid stay according to claim 1, wherein the support face (12) is arranged crosswise to the adjustment axis (9), wherein the adjustment axis (9) is arranged deviating from a perpendicular line to the support face (12).

5. Lid stay according to claim 1, wherein a support bearing (26) is provided, which is held at a variable distance to the pivot axis (3), and that compression springs (10, 11) are provided, which are supported on the one hand on the adjustment slider (8) and on the other hand on the support bearing (26).

6. Lid stay according to claim 5, wherein the support bearing (26) is supported on a bearing face (30) of an abutment bearing (29), which is pivotably supported around a rotational axis (31), and wherein the bearing face (30) has in circumferential direction a variable distance to the rotational distance (31).

7. Lid stay according to claim 6, wherein the bearing face (30) is formed to have a worm shape.

8. Lid stay according to one of claims 1 and 2 to 7, wherein the arms (1, 2) have, respectively, at a free end facing away from the pivot axis (3) connection means (35, 36) for connecting the respective arm (1, 2) with a lid or a corpus of a furniture.

9. Lid stay according to claim 5, wherein the support bearing (26) has a bore (35) extending parallel to the pivot axis (3) and which represents the connection means of the second arm (2).

10. Lid stay, comprising:

a first arm (1) and a second arm (2), which are pivotably connected to each other around a pivot axis (3) between an open position and a closed position, a convex adjustment camming contour (4), which is provided on the first arm (1) and which extends around a centre axis (5) arranged parallel to the pivot axis (3) and is formed as a circular arc, when seen in a sectional view vertical to the centre axis (5), an adjustment slider (8), which is displaceably guided by means of the second arm (1) along an adjustment axis (9) and which has a straight support face (12) directed to the adjustment contour (4) and is elastically loaded in the direction towards the adjustment contour (4), a slide shoe (13), which is, with a concave first sliding face (14), in sliding contact with the adjustment contour (4) and which is, with a straight second sliding face (15), in sliding contact to the support face (12), wherein the first sliding face (14) extends in a circular arc around the centre axis (5) with substantially the same curvature as the convex adjustment camming contour (4) and is guided along the adjustment camming contour (4).

* * * * *